US007721884B2

(12) United States Patent
Kvinge et al.

(10) Patent No.: US 7,721,884 B2
(45) Date of Patent: May 25, 2010

(54) GOLF CLUB PROTECTION SYSTEM

(75) Inventors: Marius Kvinge, Salt Lake City, UT (US); Jake Hall, Draper, UT (US)

(73) Assignee: Femte Inc., Salt Lake City, UT (US)

( * ) Notice: Subject to any disclaimer, the term of this patent is extended or adjusted under 35 U.S.C. 154(b) by 446 days.

(21) Appl. No.: 11/533,630

(22) Filed: Sep. 20, 2006

(65) Prior Publication Data

US 2008/0083630 A1 Apr. 10, 2008

(51) Int. Cl.
*A63B 57/00* (2006.01)

(52) U.S. Cl. ..... 206/315.2; 206/315.4; 150/160

(58) Field of Classification Search ..... 206/315.2, 206/315.4; 150/159, 160; 211/70.2
See application file for complete search history.

(56) References Cited

U.S. PATENT DOCUMENTS

| | | | | |
|---|---|---|---|---|
| 1,080,478 | A | 12/1913 | Reis | |
| 2,128,546 | A * | 8/1938 | Venmore | 211/70.2 |
| 2,879,819 | A | 3/1959 | Turnbull | |
| 3,117,609 | A | 1/1964 | Pio | |
| 3,664,399 | A | 5/1972 | Neff | |
| 4,195,677 | A * | 4/1980 | Hagg et al. | 150/160 |
| 4,303,172 | A | 12/1981 | Bosland | |
| 4,378,832 | A | 4/1983 | Thompson | |
| 5,000,238 | A | 3/1991 | Zeller | |
| 5,437,320 | A | 8/1995 | Sung | |
| 5,547,193 | A | 8/1996 | Sander | |
| 5,941,293 | A | 8/1999 | Serpa | |
| D423,068 | S | 4/2000 | Choe | |
| 6,044,880 | A | 4/2000 | Maeng | |
| 6,065,516 | A | 5/2000 | Chang | |
| 6,102,810 | A | 8/2000 | Boland | |
| 6,119,742 | A | 9/2000 | Maeng | |
| 6,182,859 | B1 | 2/2001 | Bolen | |
| 6,192,950 | B1 | 2/2001 | Maeng | |
| 6,202,723 | B1 | 3/2001 | Maeng | |
| 6,216,864 | B1 | 4/2001 | Chang | |
| 6,283,290 | B1 | 9/2001 | Thompson | |
| 6,321,805 | B1 | 11/2001 | Suggs | |

(Continued)

FOREIGN PATENT DOCUMENTS

| | | | |
|---|---|---|---|
| GB | 2115294 | A | 9/1983 |

(Continued)

*Primary Examiner*—Sue A Weaver
(74) *Attorney, Agent, or Firm*—Trent H. Baker; Baker & Associates PLLC

(57) ABSTRACT

The present invention relates to systems and methods for protecting a golf club head region. One embodiment of the present invention relates to a golf club protection system that protects the head region of a golf club from incidental damage. The system includes a first and second member. The first and second members are shaped to include a combined internal region corresponding to the shape of a golf club head. The first and second members are also moveably coupled to one another to enable the insertion and removal of a golf club from the system. The first member may further include a releasable shaft coupling system that releasably engages the shaft in response to a coupling force between the shaft and the first member. The nature of the moveable coupling between the first and second member may enable the second member to internally move within or overlap the first member.

7 Claims, 8 Drawing Sheets

U.S. PATENT DOCUMENTS

| | | | | |
|---|---|---|---|---|
| 6,398,025 | B2 | 6/2002 | Choe | |
| 6,431,233 | B1 | 8/2002 | Malkoff | |
| 6,484,771 | B2 | 11/2002 | Kloos et al. | |
| D475,103 | S | 5/2003 | Batista et al. | |
| 2001/0035243 | A1 | 11/2001 | Choe | |
| 2002/0124919 | A1 | 9/2002 | Butler | |
| 2002/0124920 | A1 | 9/2002 | Noyes | |
| 2003/0075252 | A1 | 4/2003 | Noyes | |
| 2003/0136486 | A1 | 7/2003 | Bradshaw | |
| 2003/0201042 | A1 | 10/2003 | Lee | |
| 2003/0213711 | A1* | 11/2003 | Kang | 206/315.2 |
| 2004/0079458 | A1 | 4/2004 | Maeng | |
| 2005/0016648 | A1 | 1/2005 | Vakharia et al. | |
| 2007/0193965 | A1* | 8/2007 | Cialdella et al. | 211/70.2 |
| 2007/0261772 | A1* | 11/2007 | Chow | 150/160 |
| 2008/0066837 | A1* | 3/2008 | Kvinge et al. | 150/160 |

FOREIGN PATENT DOCUMENTS

| | | | |
|---|---|---|---|
| GB | 2254007 | A | 9/1992 |
| GB | 2404595 | A | 2/2005 |
| JP | 2000176062 | | 6/2000 |
| JP | 2000176063 | | 6/2000 |
| JP | 2001137406 | | 5/2001 |
| JP | 200457259 | | 2/2004 |

* cited by examiner

GOLF CLUB PROTECTION SYSTEM

FIELD OF THE INVENTION

The invention generally relates to a golf club protection system. In particular, the invention relates to systems and methods for protecting a golf club head region.

BACKGROUND OF THE INVENTION

The sport of golf is played with a set of golf clubs that are utilized to strike a ball with varying performance characteristics. These clubs generally include woods, irons, putters, and various hybrids. The clubs all include a shaft, a grip and a head. The shaft is an elongated tube section that extends between the grip and the head. The grip is the interface between the user's hands and the club. The grip is generally located at the top of the shaft, while the head is oppositely located at the bottom of the shaft. The head includes one or two striking faces which are designed to make contact with the ball during use. The striking face is oriented so as to create a particular loft angle. The loft angle of the striking face corresponds to the upward lift imparted on a ball. Various grooves or patterns on the club's striking face impart a spin on the ball that affects the balls overall trajectory. The accuracy and performance of a club depends in large part on the striking face.

The striking face of a club is vulnerable to dents, dings, debris, and other objects which may cause a loss of overall club performance. For example, clubs are commonly stored in a bag with the head facing up. During transportation, the heads of the clubs often bump into one another as the bag is jarred. This incidental bumping can cause damage to the striking face of one or more of the clubs. In addition, clubs may be damaged as a result of exposure to weather or other elements such as rain or sunlight. For these reasons, various club head covers have been developed to individually protect the head region of a club from damage.

Unfortunately, existing club head covers suffer from various efficiency, manufacturing, or operational limitations. For example, many conventional covers require complex multistep processes to cover and uncover the head of a club. Likewise, the manufacturing process associated with many club covers requires that they be sold for unreasonable prices. And further, other covers are designed in a manner that does not ensure reliable engagement with the head of a club. These covers may easily slip off or misalign from the club during transportation thereby exposing the club head region to damage. Accordingly, there is a need in the industry for an improved golf club protection system that overcomes these limitations in a cost effective and utilitarian manner.

SUMMARY OF THE INVENTION

The present invention relates to systems and methods for protecting a golf club head region. One embodiment of the present invention relates to a golf club protection system that protects the head region of a golf club from incidental damage. The system includes a first and second member. The first and second members are shaped to include a combined internal region corresponding to the shape of a golf club head. The first and second members are also moveably coupled to one another to enable the insertion and removal of a golf club from the system. The first member may further include a releasable shaft coupling system that releasably engages the shaft in response to a coupling force between the shaft and the first member. The nature of the moveable coupling between the first and second member may enable the second member to internally move within or overlap the first member. A second embodiment of the present invention relates to a method for releasably coupling a golf protection system to a golf club. The method may be performed with one hand on the club and one hand supporting the golf club protection system. Alternatively, the method may be performed with only one hand when the golf club protection system is disposed on the ground.

These and other features and advantages of the present invention will be set forth or will become more fully apparent in the description that follows and in the appended claims. The features and advantages may be realized and obtained by means of the instruments and combinations particularly pointed out in the appended claims. Furthermore, the features and advantages of the invention may be learned by the practice of the invention or will be obvious from the description, as set forth hereinafter.

BRIEF DESCRIPTION OF THE DRAWINGS

In order that the manner in which the above-recited and other advantages and features of the invention are obtained, a more particular description of the invention briefly described above will be rendered by reference to specific embodiments thereof, illustrated in the appended drawings. Understanding that these drawings depict only typical embodiments of the invention and are therefore not to be considered limiting of its scope, the invention will be described and explained with additional specificity and detail through the use of the accompanying drawings, in which.

DETAILED DESCRIPTION OF THE INVENTION

The present invention may be embodied in other specific forms without departing from its spirit or essential characteristics. The described embodiments are to be considered in all respects as only illustrative and not restrictive. The scope of the invention is therefore indicated by the appended claims rather than by the foregoing description. All changes that come within the meaning and range of equivalency of the claims are to be embraced within their scope.

The present invention relates to systems and methods for protecting a golf club head region. One embodiment of the present invention relates to a golf club protection system that protects the head region of a golf club from incidental damage. The system includes a first and second member. The first and second members are shaped to include a combined internal region corresponding to the shape of a golf club head. The first and second members are also moveably coupled to one another to enable the insertion and removal of a golf club from the system. The first member may further include a releasable shaft coupling system that releasably engages the shaft in response to a coupling force between the shaft and the first member. The nature of the moveable coupling between the first and second member may enable the second member to internally move within or overlap the first member. A second embodiment of the present invention relates to a method for releasably coupling a golf protection system to a golf club. The method may be performed with one hand on the club and one hand supporting the golf club protection system. Alternatively, the method may be performed with only one hand when the golf club protection system is disposed on the ground. While embodiments of the present invention are directed at systems and methods for protecting a golf club head region, it will be appreciated that the teachings of the present invention are applicable to other fields.

The following terms are defined:

Golf club—a golfing device that includes an elongated shaft and a head.

Moveable coupling—a coupling between two members in which the members are able to move with respect to one another. For example, two members could be rotatably moveably coupled such that the two members may rotate with respect to one another.

Internal moveable coupling—a type of moveable coupling in which one of the coupled members is coupled within the other in a manner that allows for overlapping.

Chocking—a type of coupling in which a particularly sized object is positioned over an opening of a smaller size. For example, a wedge shaped door stop utilizes chocking to prevent a door from closing/opening because the wedge shaped door stop is larger in size than the opening under a door.

Figure 1:
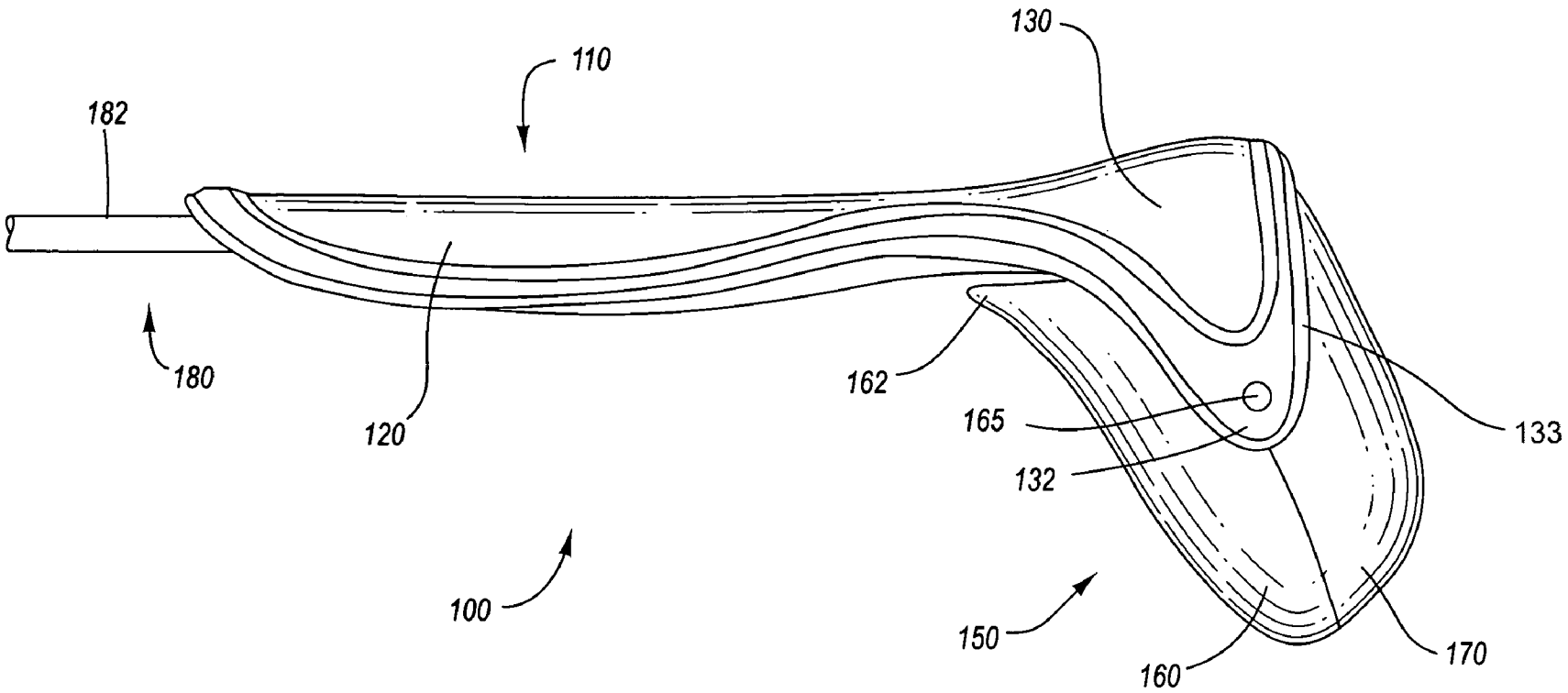
FIG. 1 illustrates a profile view of a golf club protection system in accordance with one embodiment of the present invention, wherein the system is in a closed configuration with a golf club releasably coupled within.
Figure 2:
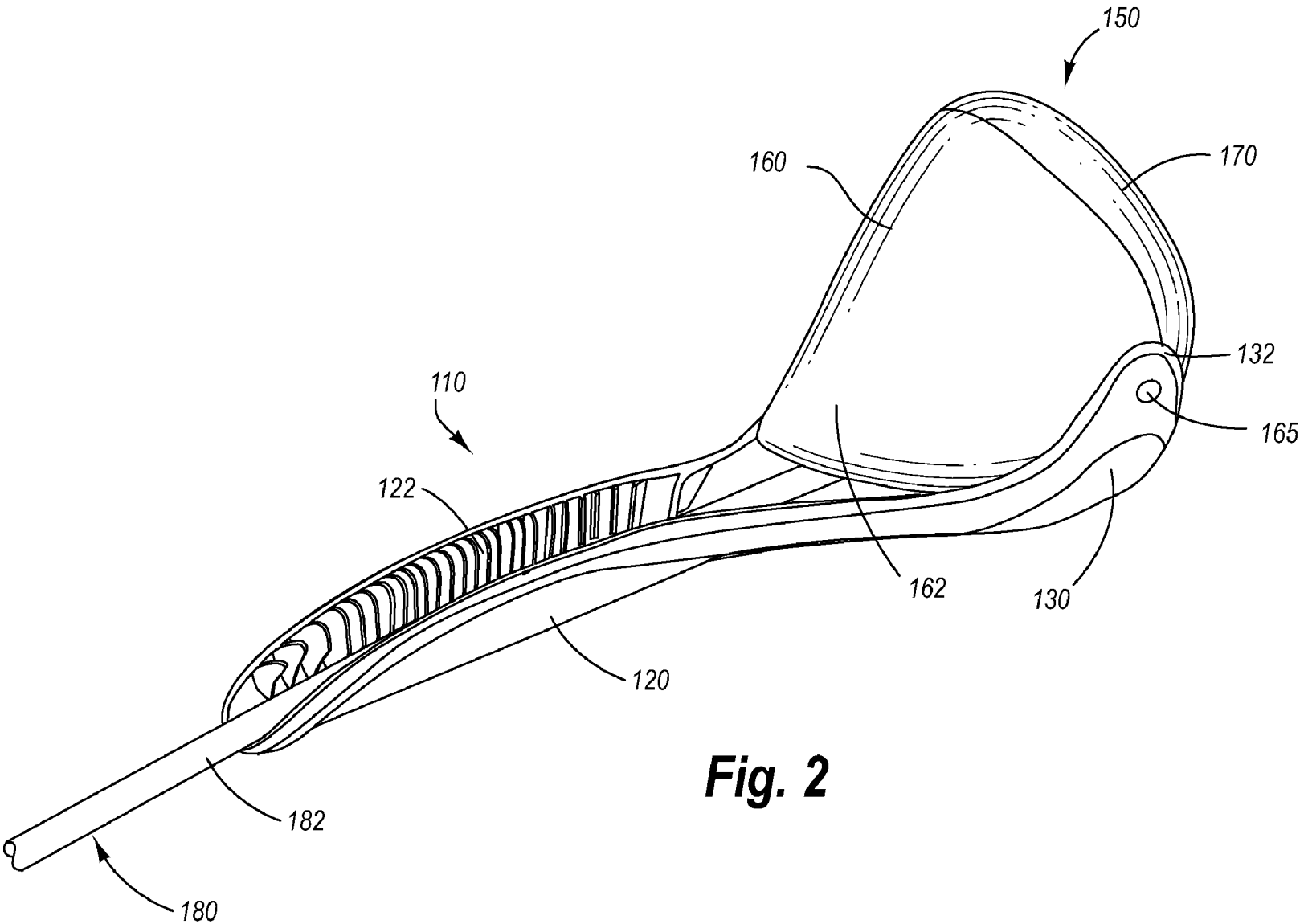
FIG. 2 illustrates a perspective view of the system illustrated in FIG. 1.

Reference is initially made to FIGS. 1 and 2, which illustrates a golf club protection system in accordance with one embodiment of the present invention, designated generally at 100. The system 100 generally includes a first cover member 110 and a second cover member 150. The system 100 may be used to protect the head region of a golf club 180 as illustrated. The head region of a golf club may include the golf club's head and a portion of the shaft. It should be noted that various sized and shaped components may be utilized to protect alternative types of golf clubs. System embodiments of the present invention relate to the interoperability of the system components and are not limited to a particular size, material composition, or shape. The illustrated first cover member 110 is composed of materials including rubber and plastic. The illustrated second cover member 150 is composed of materials including molded EVA (ethylene vinyl acetate) foam. While this set of composition materials provides particular manufacturing and performance characteristics, it will be appreciated that other materials may be used while remaining consistent with the present invention.

The first cover member 110 further includes an elongated shaft cover 120, an internal shaft channel 124 (see FIG. 4A), a plurality of teeth 122, a head cover 130, an internal head region 134 (see FIG. 4A), an optional rib 133, and a rotatable coupling area 132. The elongated shaft cover 120 is an elongated concave member configured to extend down a portion of a golf club's shaft 182 as illustrated. The internal shaft channel 124 is a hollow interior region within the elongated shaft cover 120. The internal shaft channel 124 is cupped or substantially enclosed by the elongated shaft cover 120. The plurality of teeth 122 are disposed on the internal sides of the internal shaft channel 125 as illustrated. The plurality of teeth 122 are oriented perpendicular to the longest dimension of the elongated shaft cover 120. The plurality of teeth 122 are flexible or bendable with respect to the first cover member 110. The plurality of teeth 122 are positioned and sized so as to form an opening narrower than the diameter of the golf club shaft 182. The shape, material, and positioning of the internal shaft channel 124 and the plurality of teeth form a releasable coupling system configured to releasably engage a golf club shaft utilizing the principle of chocking Alternative releasable coupling systems may be utilized and remain consistent with the present invention. The head cover 130 is positioned on one of the lengthwise ends of the elongated shaft cover 120. The head cover 130 is also a concave member shaped to conform to the enlarged head region of the golf club 180. The internal head region 134 is disposed on the interior side of the head cover. The rotatable coupling area 132 extends perpendicularly away from the head cover 130 in a direction perpendicular to the longest axis of the elongated shaft cover 120. A similarly shaped rotatable coupling area is disposed on either side of the head cover 130 to facilitate a rotatable coupling between the first and second cover members 110, 150 in the illustrated embodiment.

The second cover member 150 further includes an upper region 170, an internal upper region 174 (see FIG. 4A), a lower region 160, an internal lower region 164 (see FIG. 3A), lower point 162, and a coupler 165. The upper and lower regions 170, 160 are coupled together to form a concave shape corresponding to the size and shape of a golf club head. The internal upper and lower regions 174, 164 likewise form an internal area corresponding to the size and shape of a golf club head. The upper and lower regions 170, 160 are rotatably internally coupled to the first cover member 110 via the coupler 165. The coupling between the first and second cover members 110, 150 is positioned at a point substantially between the upper and lower regions 170, 160. The coupler 165 may be a rivet or similar coupler that enables rotatable coupling. The coupler 165 may also facilitate releasable coupling to allow alternative second cover members 150 to be interchanged with the first cover member 110, so as to accommodate different clubs, colors, patterns, etc. Further, the coupled 165 may utilize a living or compliant hinge to enable the rotatable coupling between the first and second members 110, 150. The lower region 160 includes a point 162 that protrudes away in an orientation consistent with the lengthwise length of the first cover member 110 when the second cover member 150 is positioned in the illustrated closed configuration. The internal region formed by the internal upper and lower regions 174, 164 is also shaped to correspond to the internal head region 130 of the first cover member 110 so as to provide a combined internal region 174, 164, 130 that substantially covers the head of a golf club. The upper and lower regions 170, 160 are also shaped to correspond to the exterior shape of the head cover 130 so that in a closed configuration (illustrated in FIGS. 1 and 2), the edges of the internal regions correspond to one another.

Figure 3A:
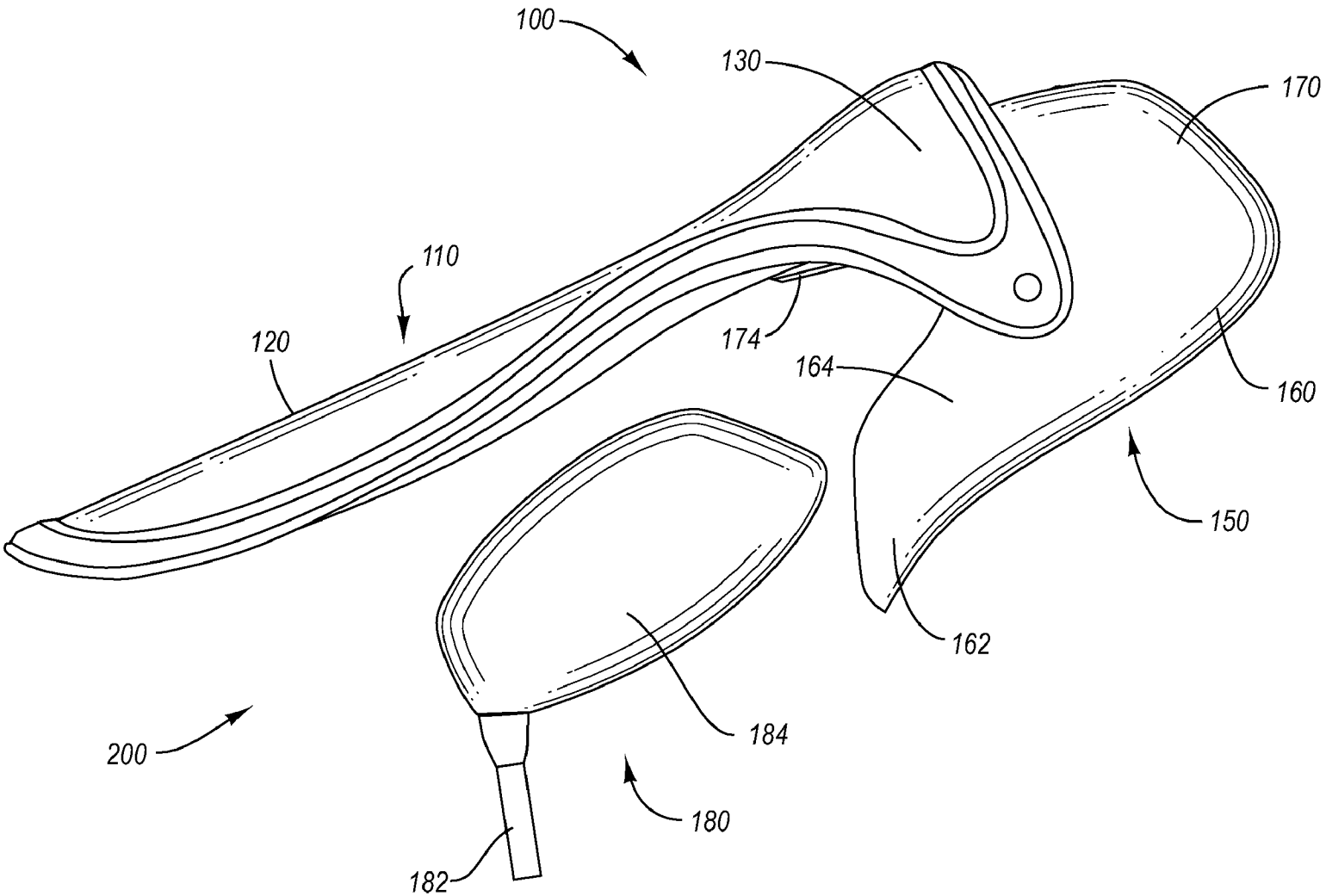
FIGS. 3A-3C illustrate a series of profile views in which a golf club is inserted into a golf club protection system in accordance with a second method embodiment of the present invention.
Figure 3B:
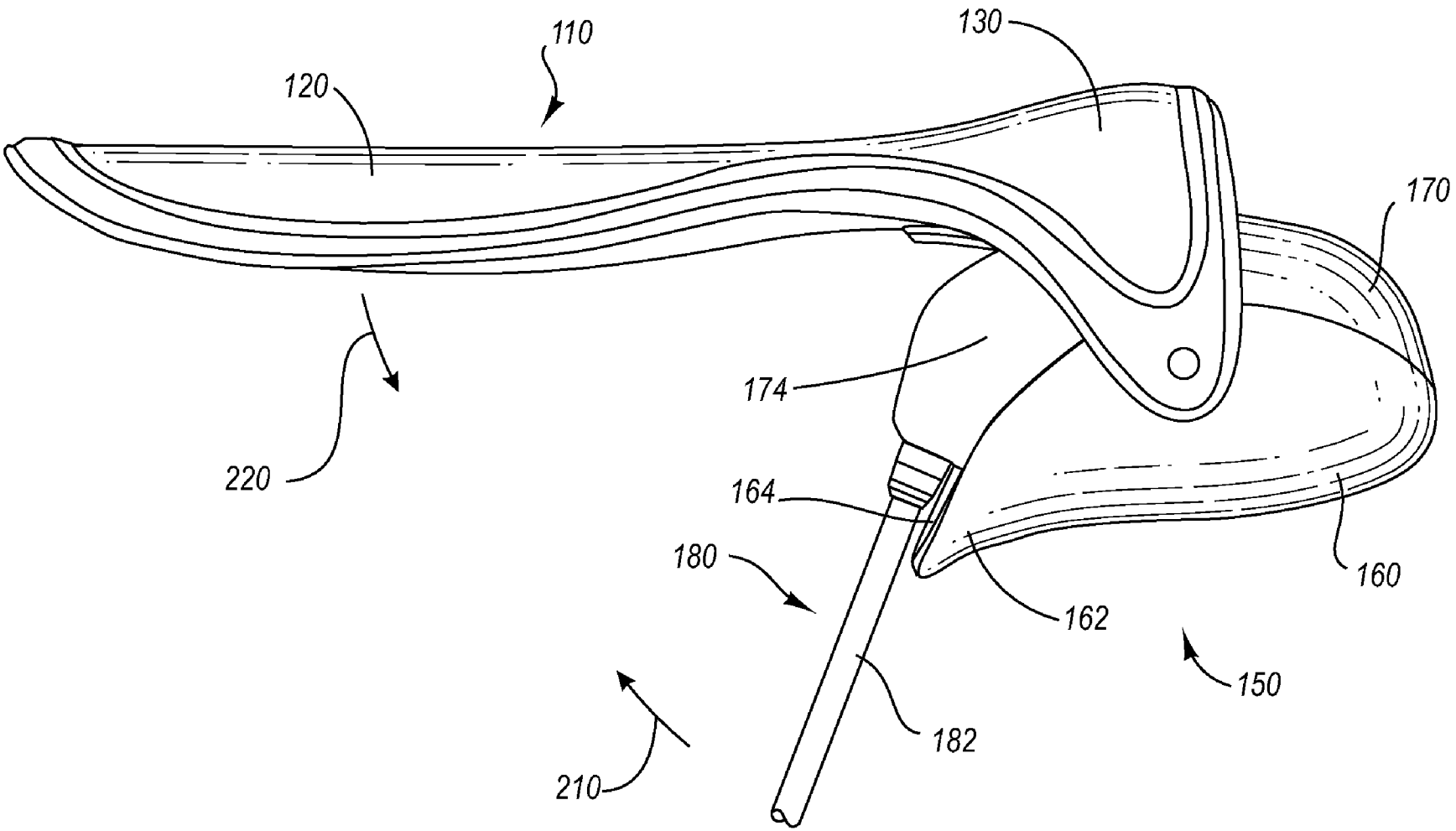
Figure 3C:
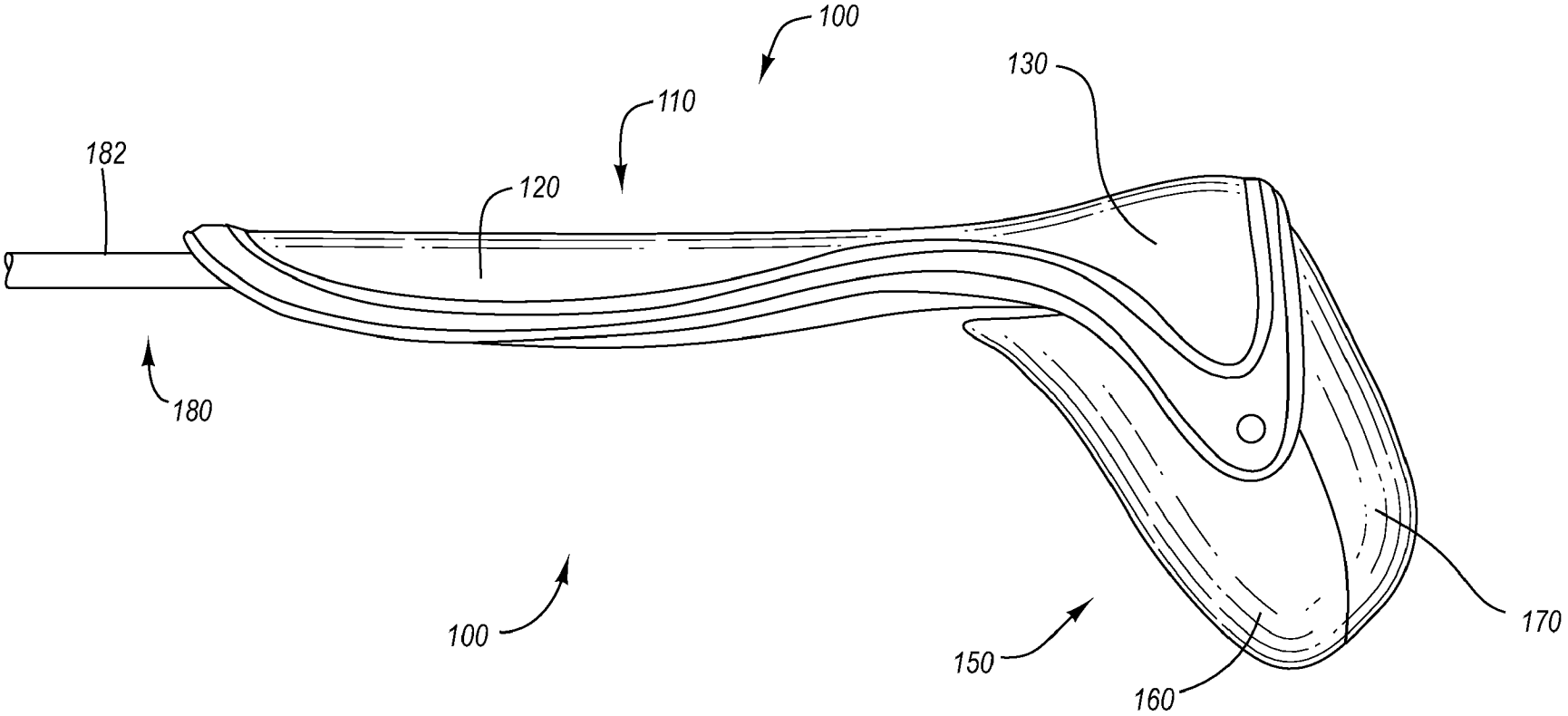

Reference is next made to FIGS. 3A-3C, which illustrate a series of profile views in which a golf club is inserted into a golf club protection system in accordance with a second method embodiment of the present invention. A golf club 180 is generally inserted into a golf club protection system after the club is used. The illustrated method embodiment utilizes the golf club protection system 100 illustrated in FIGS. 1 and 2 but may also be performed with alternative golf club protection systems while remaining consistent with the present invention. The components of the golf club protection system 100 are illustrated and described with reference to FIGS. 1 and 2. FIG. 3A represents the initial orientation of the golf club 180 with respect to the golf club protection system 100. The method is performed by a user in which the golf club protection system 100 is supported by one hand and the golf club 180 is supported by the user's second hand. The exact coupling point between the user's hands, the golf club protection system 100, and the golf club 180 may be adjusted according to a user's preference. The head 184 of the golf club 180 is aligned with the lengthwise orientation of the first and second members 110, 150. The head 184 is then directed toward the second cover member 150. As illustrated, the second cover member 150 is rotated with respect to the first cover member 110 in an open configuration, such that the internal regions 174, 164 are exposed. The open configuration may include any rotatable position in which the internal regions 174, 164 are rotated away from the head cover 130. A force 200 is directly or indirectly applied to the head 184 in the direction of the internal regions 174, 164 of the second cover member 150. The directly applied force 200 may be a user's hand on the head 184. The indirectly applied force 200 may be if the golf club 180 is rotated or pivoted in a manner that forces the head 184 in the direction described.

FIG. 3B represents the golf club 180 head 184 properly positioned within the second cover member 150 as a result of the force 200. The golf club 180 shaft 182 is then rotated toward the elongated shaft cover 120 of the first cover member 110. The shaft 182 is rotated about the head 184 of the golf club 180 such that the head 184 is substantially positionally fixed as the shaft 182 rotates toward the first cover member 110. Rotation of the shaft 182 toward the first cover member 110 may naturally be performed by moving the first cover member 110, the shaft 182, or a combination of both. The first cover member 110 may be rotated about the second cover member 150 according to force 220. Alternatively or in addition, the shaft 182 may be rotated toward the first cover member 110 according to force 210. The shaft 182 is releasably coupled to the first cover member using a releasable coupling system. The illustrated releasable coupling system includes an internal channel 124 and a plurality of teeth 122, which are flexible and form a lengthwise opening narrower than the diameter of the shaft 182. The force(s) 220, 210 cause the shaft 182 to bend the plurality of teeth 122 in a manner that forces the shaft through the opening between the opposing rows of teeth 122. The plurality of teeth 122 may be shaped to include an internally wider region between the opposing rows. The plurality of teeth 122 are also are configured to include a resilient/compliant property so as to releasably engage the shaft 182 after it is forced through the opening between the rows.

FIG. 3C represents a coupled configuration in which the golf club 180 is protected by the golf club protection system 100 and the golf club protection system 100 is in a closed configuration. As illustrated, the shaft 182 of the golf club 180 extends through the internal channel 124 of the first cover member 110 in an orientation substantially parallel to the lengthwise dimension of the elongated shaft cover 120. The shaft 182 is also releasably coupled to the first cover member 110 via the releasable coupling system described above. The head 184 (not visible) is positioned within the internal regions of the head cover 130 of the first cover member 110 and the upper and lower internal regions of the second cover member 150. The second cover member 150 is rotationally oriented with respect to the first cover member 110 so as to substantially enclose the head 184 of the golf club 180. In this orientation, a user may release the golf club protection system 100 and manipulate or position the golf club 180 while the golf club protection system 100 automatically adheres to the golf club 180 in a manner that protects the head region of the golf club.

Figure 4A:
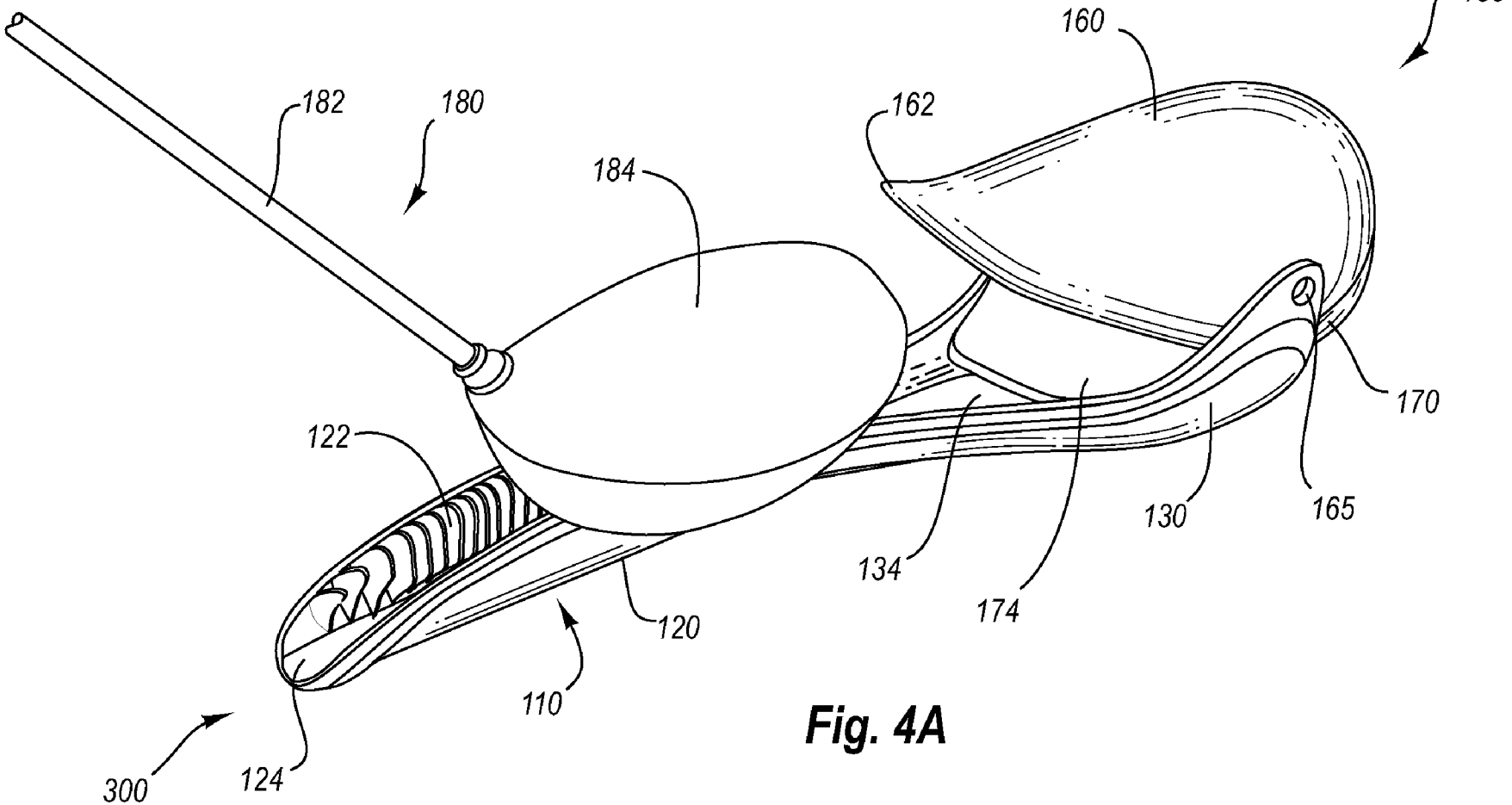
FIGS. 4A-4C illustrate a series of perspective views in which a golf club is inserted into a golf club protection system in accordance with a third method embodiment of the present invention.
Figure 4B:
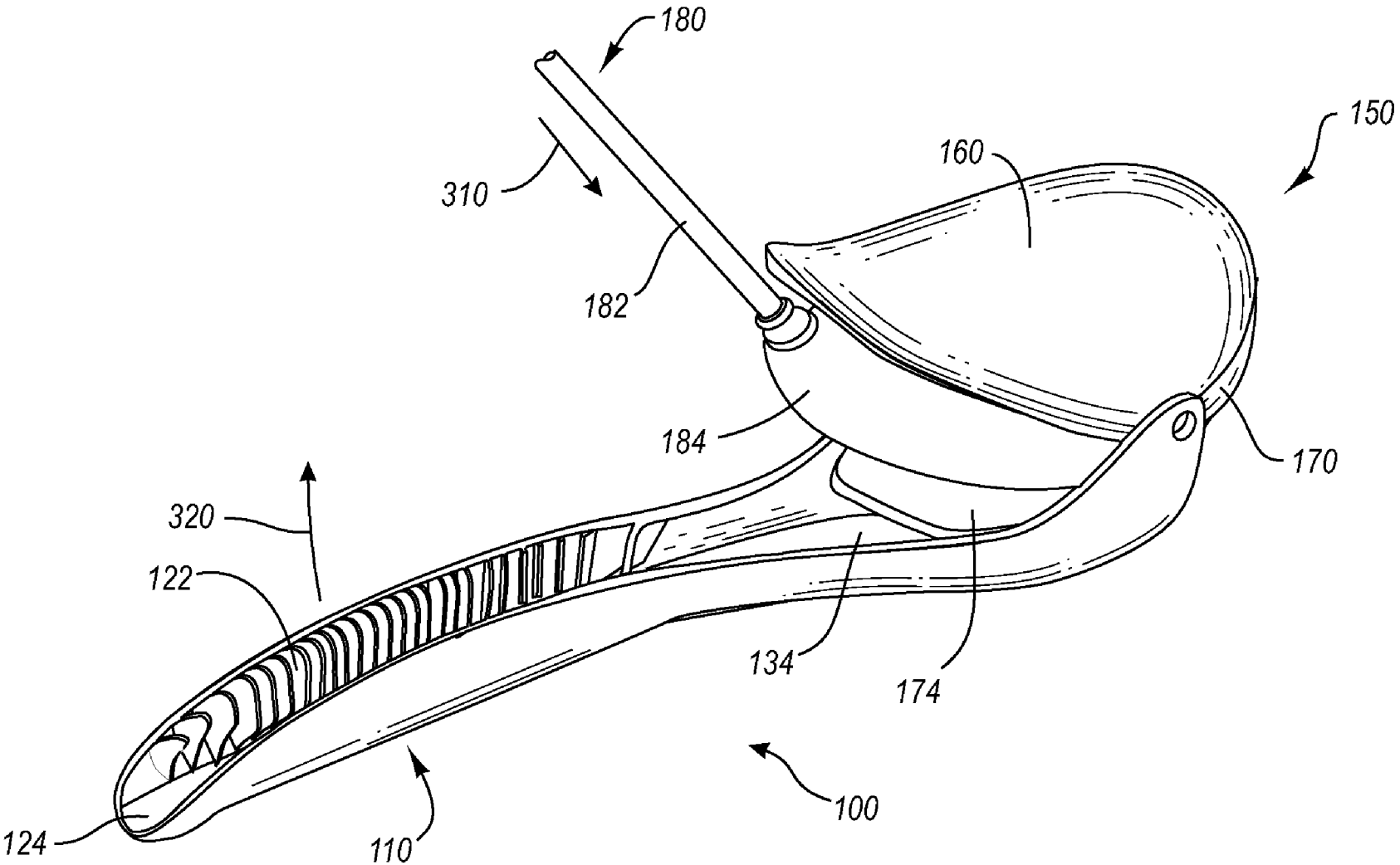
Figure 4C:
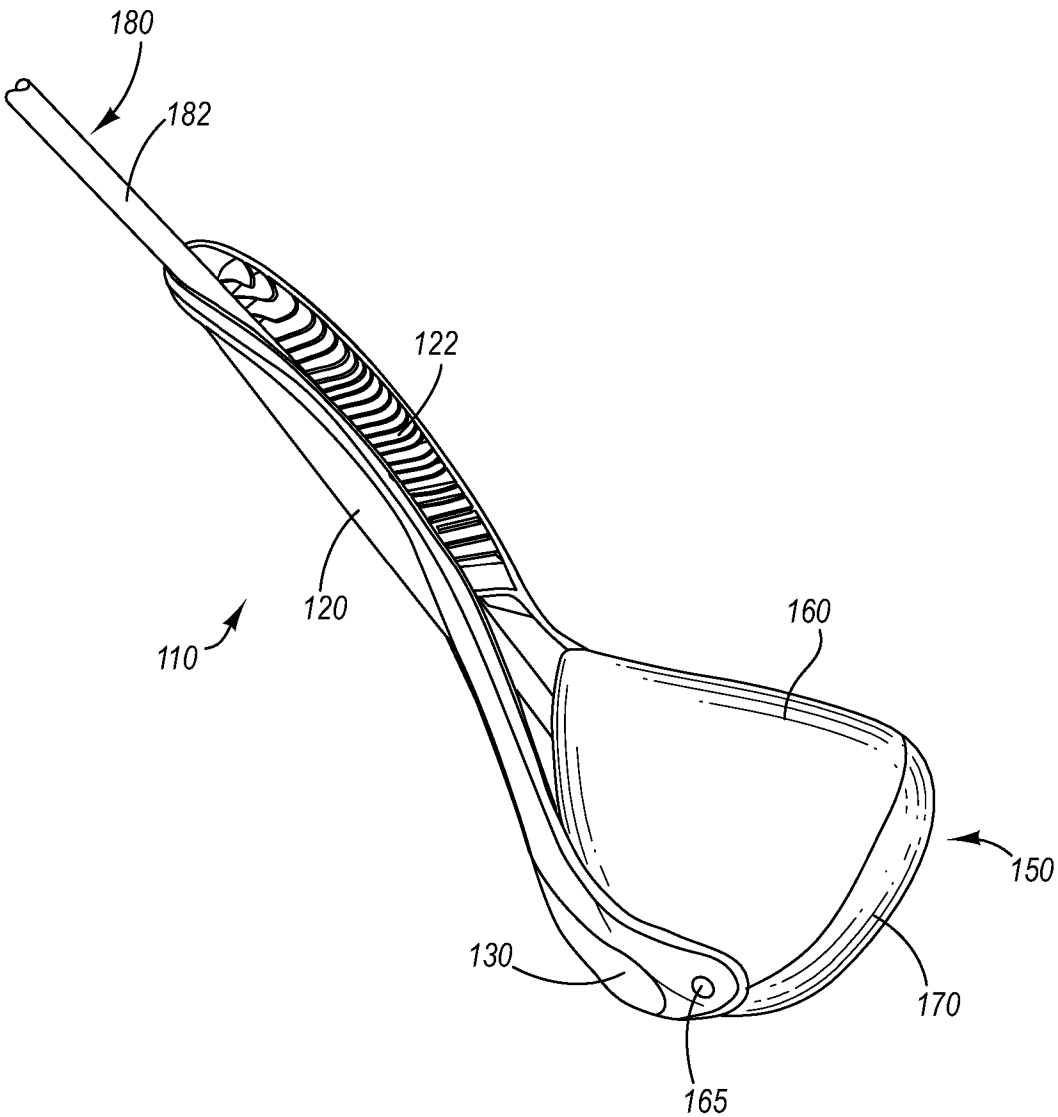

Reference is next made to FIGS. 4A-4C, which illustrate a series of perspective views in which a golf club is inserted into a golf club protection system in accordance with a third method embodiment of the present invention. This alternative method embodiment may be performed with the illustrated golf club protection system 100 disposed on the ground in an otherwise unsupported configuration. For example, a user may remove the golf club protection system 100 from a correspond club 180 and drop the golf club protection system 100 while the club 180 is being used. It should also be noted that the shape of the illustrated golf club protection system 100 is configured so as to encourage automatically rotating into the proper position in response to being dropped. The following method may then be performed by the user with a single hand coupled to the golf club 180 so as to reunite the golf club 180 and the golf club protection system 100.

The illustrated method embodiment utilizes the golf club protection system 100 illustrated in FIGS. 1 and 2 but may also be performed with alternative golf club protection systems and remain consistent with the present invention. The components of the golf club protection system 100 are illustrated and described with reference to FIGS. 1 and 2. FIG. 4A represents the initial orientation of the golf club 180 with respect to the golf club protection system 100. The head 184 of the golf club 180 is aligned with the lengthwise orientation of the first and second members 110, 150. The head 184 is then directed toward the second cover member 150. As illustrated, the second cover member 150 is rotated with respect to the first cover member 110 in an open configuration, such that the internal regions 174, 164 are exposed. The open configuration may include any rotatable position in which the internal regions 174, 164 are rotated away from the head cover 130. A force 300 is directly or indirectly applied to the head 184 in the direction of the internal regions 174, 164 of the second cover member 150. The force 200 may be applied directly when a user's hand is on the head 184 or indirectly when the golf club 180 is rotated or pivoted in a manner that forces the head 184 in the direction described.

FIG. 4B represents the golf club 180 head 184 properly positioned within the second cover member 150 as a result of the force 300. The golf club 180 shaft 182 is directed downward by force 310 toward the second cover member 150 automatically rotating the elongated shaft cover 120 of the first cover member 110 toward the shaft 182 of the golf club 180 according to force 320. This automatic response is accomplished by the rotatable coupling between the first and second cover members 110, 150 and the corresponding shapes therebetween. The automatic rotation force 320 of the first cover member 110 toward the shaft 182 forces the plurality of teeth 122 to bend in a manner that forces the shaft through the opening between the opposing rows of teeth 122, thereby releasably engaging the shaft 182 to the first cover member 110. Additional manual acts may also be performed to couple the first cover member 110 to the shaft 182 while remaining consistent with the present invention.

FIG. 4C represents a coupled configuration in which the golf club 180 is protected by the golf club protection system 100 and the golf club protection system 100 is in a closed configuration. As illustrated, the shaft 182 of the golf club 180 extends through the internal channel 124 of the first cover member 110 in an orientation substantially parallel to the lengthwise dimension of the elongated shaft cover 120. The shaft 182 is also releasably coupled to the first cover member 110 via the releasable coupling system described above. The head 184 (not visible) is positioned within the internal regions of the head cover 130 of the first cover member 110 and the upper and lower internal regions of the second cover member 150. The second cover member 150 is rotationally oriented with respect to the first cover member 110 so as to substantially enclose the head 184 of the golf club 180. In this orientation, a user may manipulate or position the golf club

180 while the golf club protection system 100 automatically adheres to the golf club 180 in a manner that protects the head region of the golf club.

Thus, as discussed herein, the embodiments of the present invention relate to systems and methods for protecting a golf club head region. The present invention may be embodied in other specific forms without departing from its spirit or essential characteristics. The described embodiments are to be considered in all respects only as illustrative and not restrictive. The scope of the invention is therefore indicated by the appended claims rather than by the foregoing description. All changes that fall within the meaning and range of equivalency of the claims are to be embraced within their scope.

What is claimed and desired to be secured by Letters Patent is:

1. A golf club protection system comprising:

a first cover member including:

an elongated shaft cover region;

a head cover region; and a second cover member including an upper region and a lower region, wherein the upper and lower region of the second cover member form an enclosed concave region with a three dimensional area substantially corresponding to a golf club head, and wherein the enclosed concave region of the second cover member and the head cover region of the first member are shaped in a manner to form a combined internal region capable of enclosing a golf club head, and wherein the second cover member is internally moveably coupled to the first cover member at a location between the upper and lower region.

2. The system of claim 1, wherein the internal moveable coupling between the first cover member and the second cover member facilitates overlapping the upper region of the second cover member within the head cover region of the first cover member.

3. The system of claim 1, wherein the internal moveable coupling between the first cover member and the second cover member enables the second cover member to internally rotate with respect to the first cover member.

4. The system of claim 1, wherein the location of the internal moveable coupling of the second cover member is at a location that enables the second cover member to internally pivot with respect to the first cover member.

5. The system of claim 1, wherein the internal moveable coupling is a hinge.

6. The system of claim 1, wherein the elongated shaft cover region further includes a releasable shaft coupling system configured to releasably engage and support a golf club shaft with respect to the first cover member.

7. The system of claim 6, wherein the releasable shaft coupling system includes a plurality of flexible teeth to releasably engage the golf club shaft via chocking.

* * * * *